United States Patent [19]

Hughes

[11] Patent Number: 4,477,028

[45] Date of Patent: Oct. 16, 1984

[54] COMMINUTER WITH COACTING DISCHARGE SCREENING DEVICE

[76] Inventor: John H. Hughes, 405 N. 18th, Elma, Wash. 98541

[21] Appl. No.: 382,483

[22] Filed: May 27, 1982

[51] Int. Cl.[3] ..... B02C 4/02; B02C 13/14

[52] U.S. Cl. ..... 241/69; 241/188 R; 241/245; 241/253; 241/257 R; 241/261

[58] Field of Search ..... 241/69, 70, 79, 79.2, 241/79.3, 46 B, 154, 161, 162, 188 R, 253, 257 R, 285 R, 55, 285 A, 56, 285 B, 57, 261, 186 R

[56] References Cited

U.S. PATENT DOCUMENTS

| | | | |
|---|---|---|---|
| 2,155,793 | 4/1939 | Komaki | 241/79.3 X |
| 3,166,301 | 1/1965 | Wooten | 241/261 X |
| 3,356,016 | 12/1967 | Eidal | 241/188 R X |
| 3,658,262 | 4/1972 | Burant, Jr. | 241/46 B |

*Primary Examiner*—Mark Rosenbaum
*Attorney, Agent, or Firm*—Christensen, O'Connor, Johnson & Kindness

[57] ABSTRACT

A solids comminuter having a circular series of upright abrasive rolls with upper end drive defines a central chamber to receive solids to be comminuted. A centrally apertured stationary bottom plate supporting the rolls defines an orifice partially covered by a free-turning screening plate to define an annular passage adjustable in width to form a size restriction gap. Driven by the swirling mass of solids pressing down against it, the screening plate drives a particle impeller housed in a receiving chamber underlying the screening orifice to pump the descending comminuted particles outwardly through a discharge passage in the wall of the receiving chamber.

9 Claims, 8 Drawing Figures

26
22b
22c
10
40
38
42
44
2
3
4
5
32
38
22a
12
14
30
56
28
24
50b
22
22
50
56
16
68
16a
68a
64
62
68b
18
18
20
G

Fig. 2.
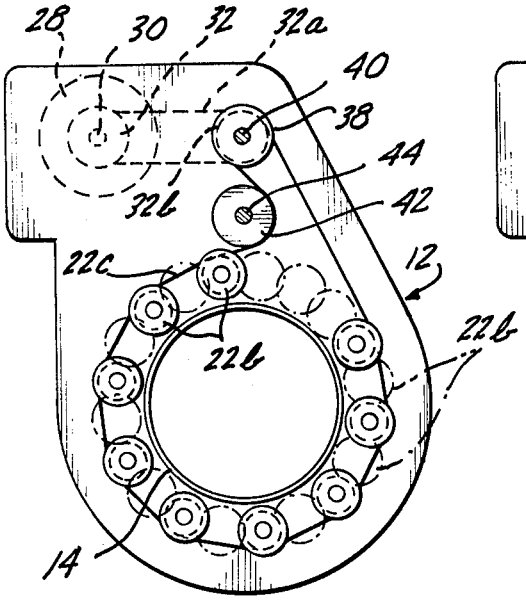
Fig. 3.
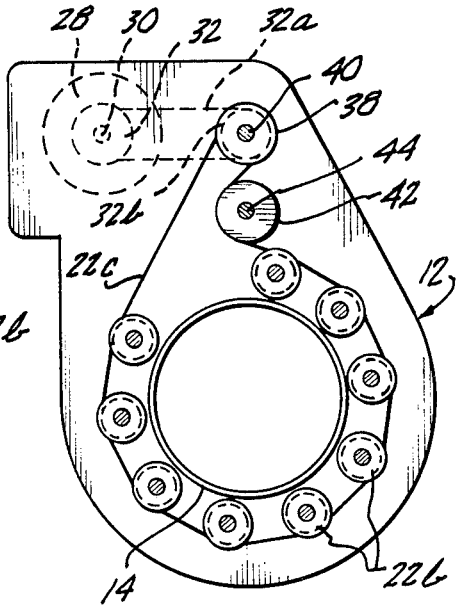
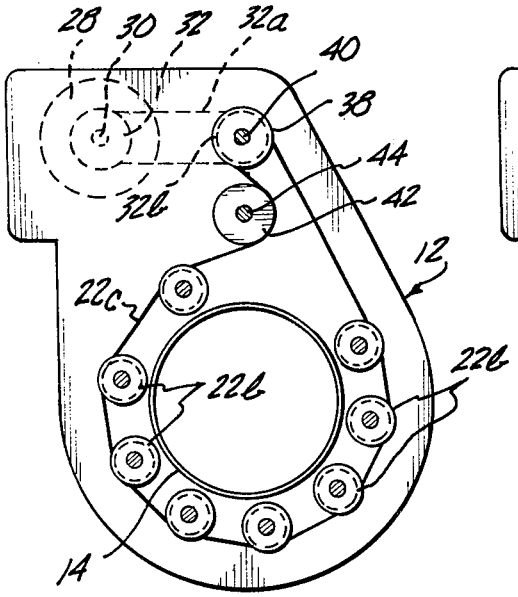
Fig. 4.
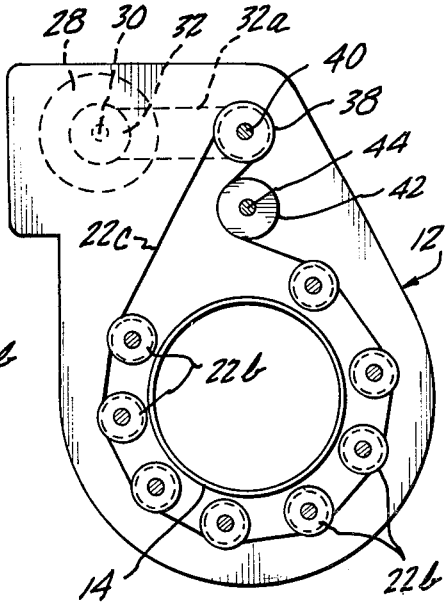
Fig. 5.

COMMINUTER WITH COACTING DISCHARGE SCREENING DEVICE

BACKGROUND OF THE INVENTION

This invention relates to improvements in apparatus for comminuting solids, such as chunks of wood, bark, rock, junked sheet metal articles, etc., and is herein illustratively described in its presently preferred form as an improvement in the subject matter of copending application Ser. No. 166,232, filed July 7, 1980 since issued as U.S. Pat. No. 4,366,928 on Jan. 4, 1983.

An object hereof is to provide an improved comminuter with coacting means for screening the discharge from the comminuting chamber and, more specifically, of providing a nonplugging screening device that functions effectively at varying product flow-through rates.

A more specific object is to devise a rotary comminuter with a coacting screening device of low-cost, simple and durable form readily adjusted to accommodate different types of materials being comminuted and different upper size limit restrictions applied to the particles permitted to exit from the apparatus.

A related object hereof is to provide a combined comminuter and discharge screening apparatus driven from a single power source, with the assembly so organized and arranged as to render the internal components readily accessible for inspection and repair, as well as for ease and convenience of adjustability in the setting of the screening apparatus to accommodate different types and particle size requirements in the discharge of materials.

A specific objective is to provide in such a rotary comminuter combined screening and particle output pumping mechanism that, for a number of applications, may be driven by rotary, swirling motion of the mass of solids and comminuted material to function at the required rate in order to sustain product flow through the combined system.

SUMMARY OF THE INVENTION

In accordance with its preferred form, the apparatus housing structure, the power drive system, the circular array of upright elongated comminuter rollers, and the lower frame structure supporting the rolls form a stationary structure mounted at an elevation providing ground clearance for the convenient mounting and dismounting of the discharge screening and pumping subassembly at the base of such structure. A vaned product-driven screening plate set with adjustable clearance relative to a screening aperture in the housing bottom provides a size restriction output flow passage. The screening plate, itself preferably driven in rotation by the swirling mass of materials in the comminuting chamber, preferably also serves as a drive for an underlying multivaned product discharge impeller. The screening plate and discharge impeller comprise the dismountable subassembly that may be readily lowered to floor level or ground level for gaining access to the interior of the comminuting chamber and for repair and replacement or adjustment of parts within the system. The edge of the rotary product-driven screening plate is preferably of scalloped form, cooperating with the housing bottom annular orifice edge in providing a non-plugging discharge passage.

These and other features, objects and advantages of the invention will become more fully evident as the description proceeds with reference to the accompanying drawings.

BRIEF DESCRIPTION OF THE DRAWINGS

FIGS. 2 through 5 are horizontal sectional views depicting the comminutor roll belt drive.

DETAILED DESCRIPTION REFERRING TO DRAWINGS

Figure 1:
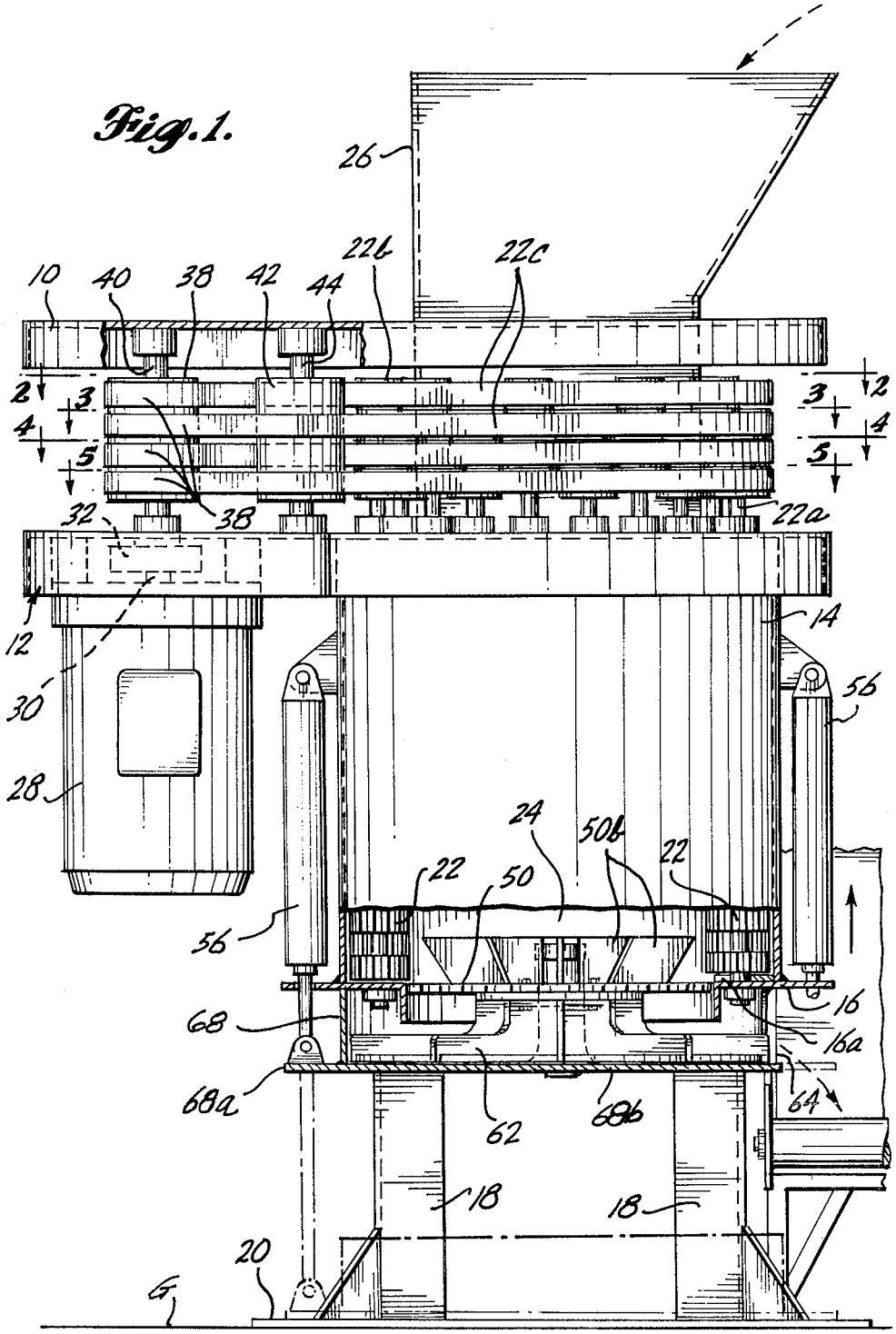
FIG. 1 is a side elevation view of the comminutor apparatus in its preferred form with parts broken away to show among other features, the lower subassembly including the particle screening and discharge means.

The comminuter frame structure includes vertically spaced horizontal upper frame plates 10 and 12, a depending tubular housing 14 and a base structure including the annular frame bottom plate 16. The frame assembly is supported on a group of corner posts 18 suitably braced and anchored by pedestal 20 to the floor or ground foundation G. A circular series of closely spaced comminuter rolls 22 mounted to rotate about vertical axes extending around the inside periphery of housing 14 defines a central comminuting chamber 24. A feed hopper 26 mounted on the upper frame plates 10 and 12 rises above the central comminuting chamber 24 to introduce solid into the chamber through the open top thereof. The codirectionally driven rolls 22 have surface projections or irregularities causing them to abrasively engage solids introduced into the chamber, causing the solids to tumble about individually and to swirl orbitally as a mass around the chamber.

Each of the comminuter rolls 22 is driven by the motor 28 through a system of sheaves and drive belts, as shown in FIGS. 1 through 5. Drive motor 28 mounted on the underside of frame plate 12 with its axis vertical, has a drive shaft 30 carrying an input sheave 32 coupled by belt **32*a* to a driven sheave 32*b* mounted on a counter-shaft 40. The latter mounts and drives a series of sheaves 40 (four in the illustration). Each roll 22 has a stub shaft 22*a* projecting upwardly therefrom and mounts a sheave 22*b* engaged by a drive belt 22*c* coupling that sheave with others in the same plane and with the sheave 32 also occupying that plane. Because of the close spacing of the successive comminuting rolls 22 and the clearances required to accomodate the sheaves driving them, the sheaves around the series lie in successive recurring stair-step vertically offset relationship in the four belt and sheave drive planes. A second counter-shaft 44 cooperating with a drum 42 deflects one stretch of all the belts 22*c*** to provide desired belt tension.

Figure 6:
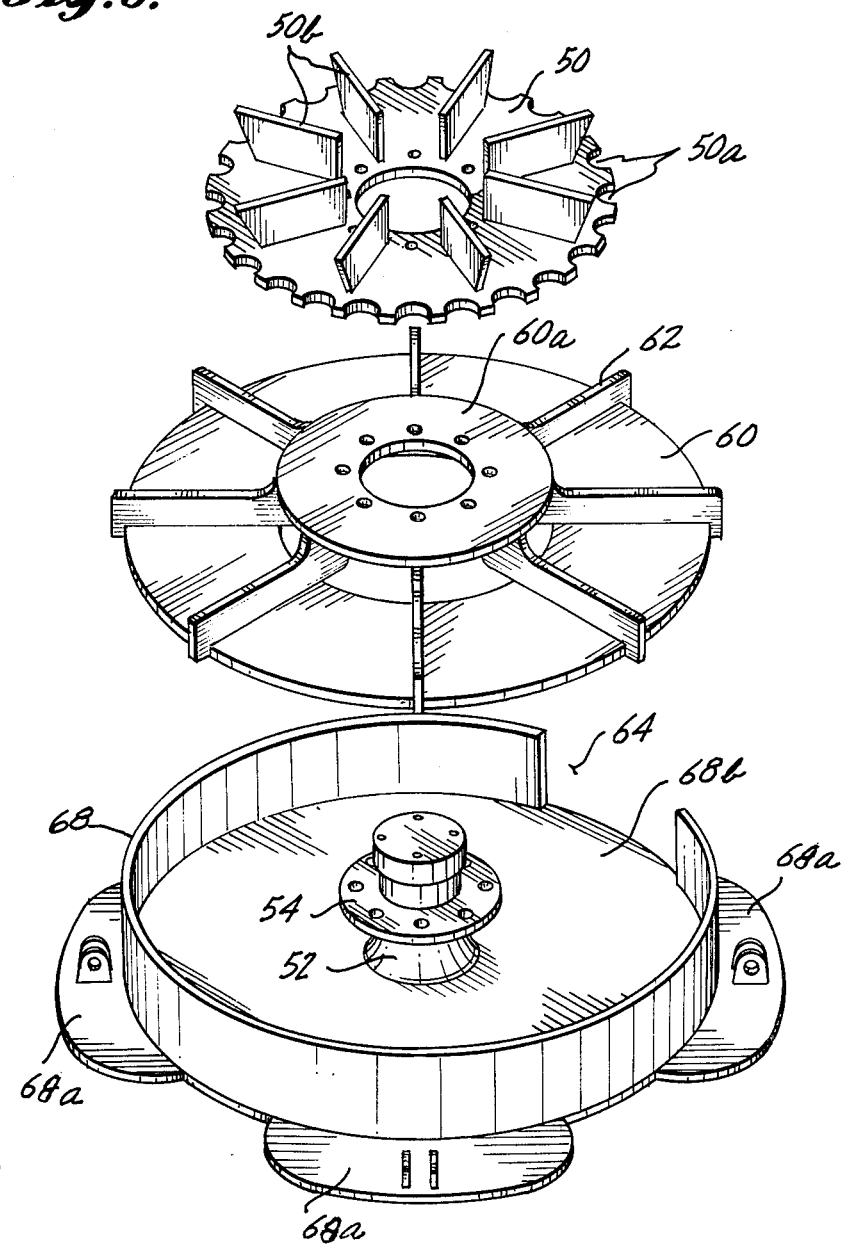
FIG. 6 is an exploded isometric of parts making up the particle screening and discharge pump subassembly, removably mounted at the base of the comminuting device.

Annular stationary bottom plate 16 defines an circular orifice with a rim or edge **16*a*. A rotary screening plate 50 mounted on an upright support spindle 52 central to the comminuting chamber 24 is positioned in superimposed registry with the orifice 16*a*. Spindle 52 has a mounting plate 54. The spindle itself is rotatively mounted on a base plate 54** which can be raised and lowered between an elevated operating position shown in FIG. 1 and a depressed position providing access to the interior of the chamber 24 and also to the screening plate itself. Positioning movement of this bottom assembly is caused by hydraulic jacks 56. In its normal operating position, rotary screening plate 50 is either in vertical registry with or lies at a selected distance above the orifice rim 16*a*. As shown best in FIG. 6, the peripheral edge of screening plate 50 has a succession of scallops 50*a* forming widened passages through which comminuting particles may pass. The plate 50 also mounts a succession of upright topside generally radial vanes 50*b*. It is bolted to an underlying coaxial particle pump impeller also in the form of a disk or round plate 60 mounting a succession of upright topside generally radial vanes 62. A mounting plate 60*a* welded to the top edges of the vanes 62 has a series of bolt holes registering with similar holes in plate 60*a* and screening plate 50 by which to bolt the two rotors (50 and 60) to the spindle 52. The rotor 60 is accommodated within a cup-shaped particle receiving chamber 68. Spindle 52 is mounted centrally on the bottom plate 68*b* of such chamber. The rotor bottom plate 60 with vanes 62 serves as a particle pump or impeller driving the particles outwardly by centrifugal force until they exit through opening 64 in the annular wall of such chamber. The bottom plate 68*b* has a series of projecting ears 68*a* to which the actuator rods of the upright hydraulic jacks 56 are coupled as shown in FIG. 1.

In operation, the massed solids caused to tumble and swirl in the comminuting chamber 24, press downwardly on the vaned screening plate 50 and cause the plate to rotate, and with it the vaned particle impeller 60. The gap or passage defined between the orifice rim 16*a* and the periphery of the screening plate serves as a size restriction passage or filter allowing only particles of a certain size and smaller to pass downwardly into the receiving chamber 68 where they are pumped outwardly and discharged through the opening 64. Because the scallops or notches in the peripheral edge of the plate 50 serve as the principal passages for comminution particles, it might be thought that there would be a tendency for these openings to plug up with particles jammed into them. It is found, however, that rotation of the screening plate in response to the tumbling and swirling motion of the solids continuously clears these openings for passage of the materials down into the receiving chamber.

By interposing shims of different thickness (or numbers) between the screening plate 50 and the mounting plate 60*a* of impeller 60 vertical clearance of different width may be provided between the peripheral edge of the screening plate and the orifice rim 16*a*, thereby to vary the width of the size restriction passage for discharge of particles from the bottom of the comminuting chamber.

Figure 8:
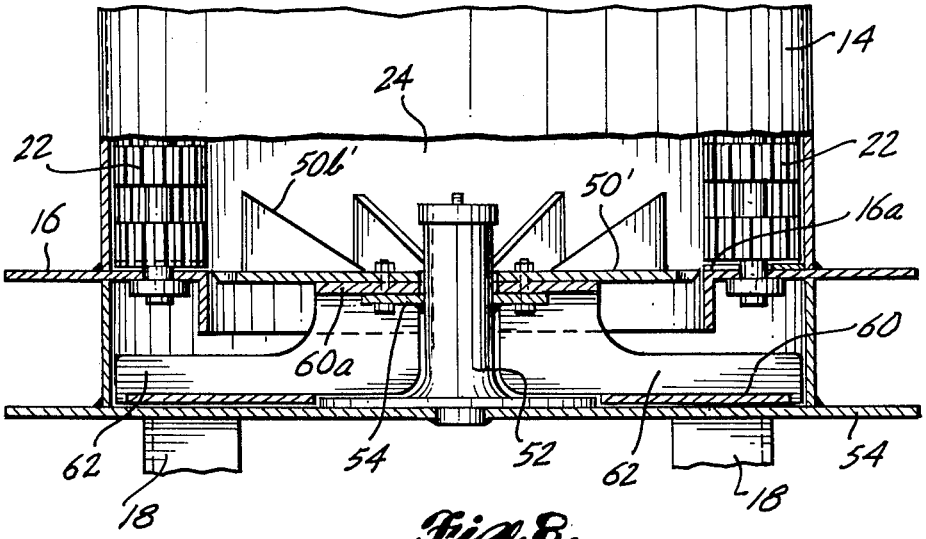
FIGS. 7 and 8 are enlarged side elevation views with parts broken away to show the lower subassembly with a modified rotary screening plate and to illustrate the use of shims making the size restriction passage of different width in the two views.
Figure 7:
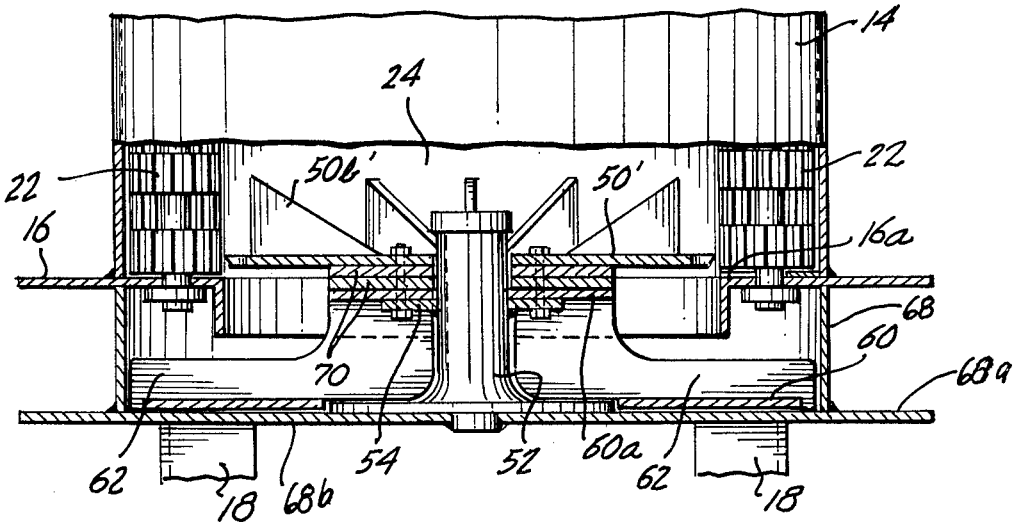

The shape of the vanes 50*b* may be varied. An illustration of a different vane shape is shown in FIGS. 7 and 8 wherein the vanes 50*b*′ on screening plate 50′, instead of having flat or horizontal upper edges, vertical inner edges and downwardly and inwardly inclined outer edges, have upright outer edges and an upper edge that slopes inwardly and downwardly from the maximum height at the outermost extremity down to the level of the screening plate itself. In other respects, the assembly is similar to that shown in the previous series of figures.

FIGS. 7 and 8 also illustrate the use of shims 70 interposed between screening plate 50′ and the underlying mounting flange or plate 60*a* in order to increase the clearance gap between the orifice rim 16*a* and the outer peripheral edge of the screening plate. In addition, FIGS. 7 and 8 illustrate a screening plate which is somewhat further modified in that its outer lower edge is beveled. While not illustrated in the drawings, the outlying spaces between the rolls 22 and the annular housing wall 14 may be filled with blocking material or arcuate shields mounted closely adjacent to the back sides of the rolls in order to prevent build up of particles behind the rolls. These illustrate but a few of the optional additions and variations that are possible within the concept of the invention in order to provide effective flow-through, nonplugging screening action in a simple and direct manner which requires no separate power to operate not only the screening device itself but also the particle discharge pump associated with and driven by it.

In order to service and maintain the device, and in order to inspect the interior of the comminuting chamber as well as to provide a convenient means to add or remove shims or to charge screening plates, the hydraulic jacks 56 are simply actuated to lower the bottom subassembly comprising the screening plate, discharge pump and particle receiving housing in which the pump is mounted, all as shown by broken lines in FIG. 1. When the servicing is completed, the jacks are operated in reverse in order to raise the subassembly into operating position.

The illustrated preferred embodiment thus described relies upon driven rotation of the particle screen plate 50 and vaned discharge impeller 60 conjointly by the swirling mass of materials within the comminuting chamber. There are special advantages in that arrangement. However, for some applications it may be preferred or even necessary to drive the screen plate by a separate mechanical drive, such as in grinding rocks, which have such density as to pack in the base of the comminuting chamber. It is also possible, of course, to drive the discharge impeller 60 independently in any case. This may be desirable, for instance, when it is advantageous for the impeller 60 to function essentially as a blower rotated at much higher speed than that best for the screen plate.

These and other variations are contemplated within the broader aspects of the invention and embraced within the set of claims that follow.

The embodiments of the invention in which an exclusive property or privilege is claimed are defined as follows:

1. Apparatus for comminuting solids such as rocks and chunks of wood comprising first means housing and stationarily mounting for rotation an annular series of successively adjacent, elongated, generally cylindrical upright comminuting rolls having article abrading projections on the surfaces thereof, the series of said rolls defining an open upright generally tubular comminuting chamber encompassed by the rolls, drive power means applying drive torque for codirectionally rotating each of said rolls, said first means providing an opening leading into an upper region of said chamber for introduction of solids to be comminuted by action of the driven rolls, causing the solids to tumble against the rolls and each other and to undergo orbital swirling motion as a mass within said chamber, second means forming a bottom for the chamber to support such solids in said chamber and including an annular housing base member defining a central generally horizontal orifice in register with said chamber, and a rotative screening member mounted to turn on an upright axis in superposed register with said orifice and having a peripheral edge spaced from the edge of said orifice so as to define therebetween a size restriction passage for descending particles comminuted from such solids by abrasive action on said rolls, said screening member rotating codirectionally with the swirling motion of the overlying solids in said chamber.

2. The apparatus defined in claim 1, wherein the screening member is driven in rotation by the orbital swirling motion of the mass of solids bearing against the screening member and has upper surface projection elements tractionally engageable by such solids to drive the screening member in rotation.

3. The apparatus defined in claim 1 or 2 wherein the peripheral edge of the screening member has a succession of recesses along the same which vary the width of the passage between such edge and the orifice edge.

4. The apparatus defined in claim 1 or 2 including means forming a particle receiving chamber lying beneath the comminuting chamber bottom and having a rotary impeller therein connected coaxially with the screening member to be rotated with such screening member, said receiving chamber having a discharge opening, said rotary impeller having a plurality of generally radial vanes forming pockets between them into which the particles dropping through said passage are received to be impelled radially outward and through said discharge opening by rotation of said impeller.

5. The apparatus defined in claim 1 or 2 wherein the means mounting the screening member is adapted to permit adjustment of the width of the size restriction passage.

6. The apparatus defined in claim 1 or 2 wherein the means mounting the screening member is adapted to permit adjustment of the width of the size restriction passage, and means forming a particle receiving chamber lying beneath the comminuting chamber bottom and having a rotary impeller therein connected coaxially with the screening member to be rotated by such screening member, said receiving chamber having a discharge opening, said rotary impeller having a plurality of generally radial vanes forming pockets between them into which the particles dropping through said passage are received to be impelled radially outward and through said discharge opening by rotation of said impeller.

7. The apparatus defined in claim 1 or 2 wherein the means mounting the screening member is adapted to permit adjustment of the width of the size restriction passage, means forming a particle receiving chamber lying beneath the comminuting chamber bottom and having a rotary impeller therein connected coaxially with the screening member to be rotated by such screening member, said receiving chamber having a discharge opening, said rotary impeller having a plurality of generally radial vanes forming pockets between them into which the particles dropping through said passage are received to be impelled radially outward and through said discharge opening by rotation of said impeller, the drive means for the rolls being mounted adjacent and drivingly connected to the upper ends of the rolls, said screening member, its mounting means and said rotary impeller being interconnected in a subassembly removably mounted on the lower end of the housing means to permit lowering the subassembly in relation to the housing base member to provide access to the interior of the comminuting chamber and thereby to the rolls without disconnecting the rolls from said drive means.

8. The apparatus defined in claim 1 or 2 wherein the means mounting the screening member is adapted to permit adjustment of the width of the size restriction passage, means forming a particle receiving chamber lying beneath the comminuting chamber bottom and having a rotary impeller therein connected coaxially with the screening member to be rotated by such screening member, said receiving chamber having a discharge opening, said rotary impeller having a plurality of generally radial vanes forming pockets between them to which the particles dropping through said passage are received to be impelled radially outward and through said discharge opening by rotation of said impeller, the drive means for the rolls being mounted adjacent and drivingly connected to the upper ends of the rolls, said screening member, its mounting means and said rotary impeller being interconnected in a subassembly removably mounted on the lower end of the housing means to permit lowering the subassembly in relation to the housing base member to provide access to the interior of the comminuting chamber and thereby to the rolls without disconnecting the rolls from said drive means, the peripheral edge of the screening member having a succession of recesses along the same which varies the width of the passage between such edge and the orifice edge.

9. The apparatus defined in claim 1 or 2 including means forming a particle receiving chamber lying beneath the comminuting chamber bottom and having a rotary impeller therein, said receiving chamber having a discharge opening, said rotary impeller having a plurality of generally radial vanes forming pockets between them into which the particles dropping through said passage are received to be impelled radially outward and through said discharge opening by rotation of said impeller.

* * * * *